US006901391B2

(12) United States Patent
Storm, Jr. et al.

(10) Patent No.: US 6,901,391 B2
(45) Date of Patent: May 31, 2005

(54) FIELD/RESERVOIR OPTIMIZATION UTILIZING NEURAL NETWORKS

(75) Inventors: Bruce H. Storm, Jr., Houston, TX (US); Roger L. Schultz, Aubrey, TX (US); John R. Dennis, Bozeman, MT (US); John M. Richardson, Norman, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 52 days.

(21) Appl. No.: 10/051,323

(22) Filed: Jan. 18, 2002

(65) Prior Publication Data

US 2002/0138241 A1 Sep. 26, 2002

(30) Foreign Application Priority Data

Mar. 21, 2001 (WO) ..... PCT/US01/09454

(51) Int. Cl.[7] ..... G06F 15/18
(52) U.S. Cl. ..... 706/16; 70/25
(58) Field of Search ..... 706/16; 70/25

(56) References Cited

U.S. PATENT DOCUMENTS 5,444,619 A 8/1995 Hoskins et al. ..... 702/13
6,002,985 A 12/1999 Stephenson ..... 702/13
6,012,015 A 1/2000 Tubel ..... 707/3
6,021,377 A 2/2000 Dubinsky et al. ..... 702/9
6,101,447 A 8/2000 Poe, Jr. ..... 702/13

FOREIGN PATENT DOCUMENTS

EP 0 881 357 A2 12/1998

OTHER PUBLICATIONS

Yang et al, "A Neural Network Approach to Predict Existing and In–Fill Oil Well Performance", IEEE , I. JCNN, Jul. 2000.*
IEEE Transactions on Geoscience and Remote Sensing, vol. 33, No. 4, pp. 971–980; Dated, Jul. 1, 1995.
IEEE Proceedings of the International Conference on Neural Networks, vol. 5, pp. 3289–3294; Dated, Jun. 27, 1994.

* cited by examiner

*Primary Examiner*—George Davis
(74) *Attorney, Agent, or Firm*—Robert A. Kent; Marlin R. Smith

(57) ABSTRACT

A method of optimizing performance of a well system utilizes a neural network. In a described embodiment, the method includes the step of accumulating data indicative of the performance of the well system in response to variable influencing parameters. The data is used to train a neural network to model an output of the well system in response to the influencing parameters. An output of the neural network may then be input to a valuing model, e.g., to permit optimization of a value of the well system. The optimization process yields a set of prospective influencing parameters which may be incorporated into the well system to maximize its value.

15 Claims, 3 Drawing Sheets

FIELD/RESERVOIR OPTIMIZATION UTILIZING NEURAL NETWORKS

CROSS-REFERENCE TO RELATED APPLICATION

The present application claims the benefit under 35 USC §119 of the filing date of prior PCT application no. PCT/US01/09454, filed Mar. 21, 2001, the disclosure of which is incorporated herein by this reference.

BACKGROUND

The present invention relates generally to methods of optimizing the performance of subterranean wells and, in an embodiment described herein, more particularly provides a method of optimizing fields, reservoirs and/or individual wells utilizing neural networks.

Production of hydrocarbons from a field or reservoir is dependent upon a wide variety of influencing parameters. In addition, a rate of production from a particular reservoir or zone is typically limited by the prospect of damage to the reservoir or zone, water coning, etc., which may diminish the total volume of hydrocarbons recoverable from the reservoir or zone. Thus, the rate of production should be regulated so that an acceptable return on investment is received while enhancing the ultimate volume of hydrocarbons recovered from the reservoir or zone.

The rate of production from a reservoir or zone is only one of many parameters which may affect the performance of a well system. Furthermore, if one of these parameters is changed, another parameter may be affected, so that it is quite difficult to predict how a change in a parameter will ultimately affect the well system performance.

It would be very advantageous to provide a method whereby an operator of a well system could conveniently predict how the well system's performance would respond to changes in various parameters influencing the well system's performance. Furthermore, it would be very advantageous for the operator to be able to conveniently determine specific values for the influencing parameters which would optimize the economic value of the reservoir or field.

SUMMARY

In carrying out the principles of the present invention, in accordance with an embodiment thereof, a method is provided which solves the above problem in the art.

In one aspect of the present invention, a method is provided wherein a neural network is trained so that it models the performance of a well system. Data sets including known values for influencing parameters and known values for parameters indicative of the well system's performance in response to the influencing parameters are used to train the neural network. After training, the neural network may be used to predict how the well system's performance will be affected by changes in any of the influencing parameters.

In another aspect of the present invention, the trained neural network may be used along with a reservoir model and a financial model to yield a net present value. Prospective influencing parameters may then be input to the neural network, so that the affects of these parameters on the net present value may be determined. In addition, optimization techniques may be utilized to determine how the influencing parameters might be set up to produce a maximum net present value.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
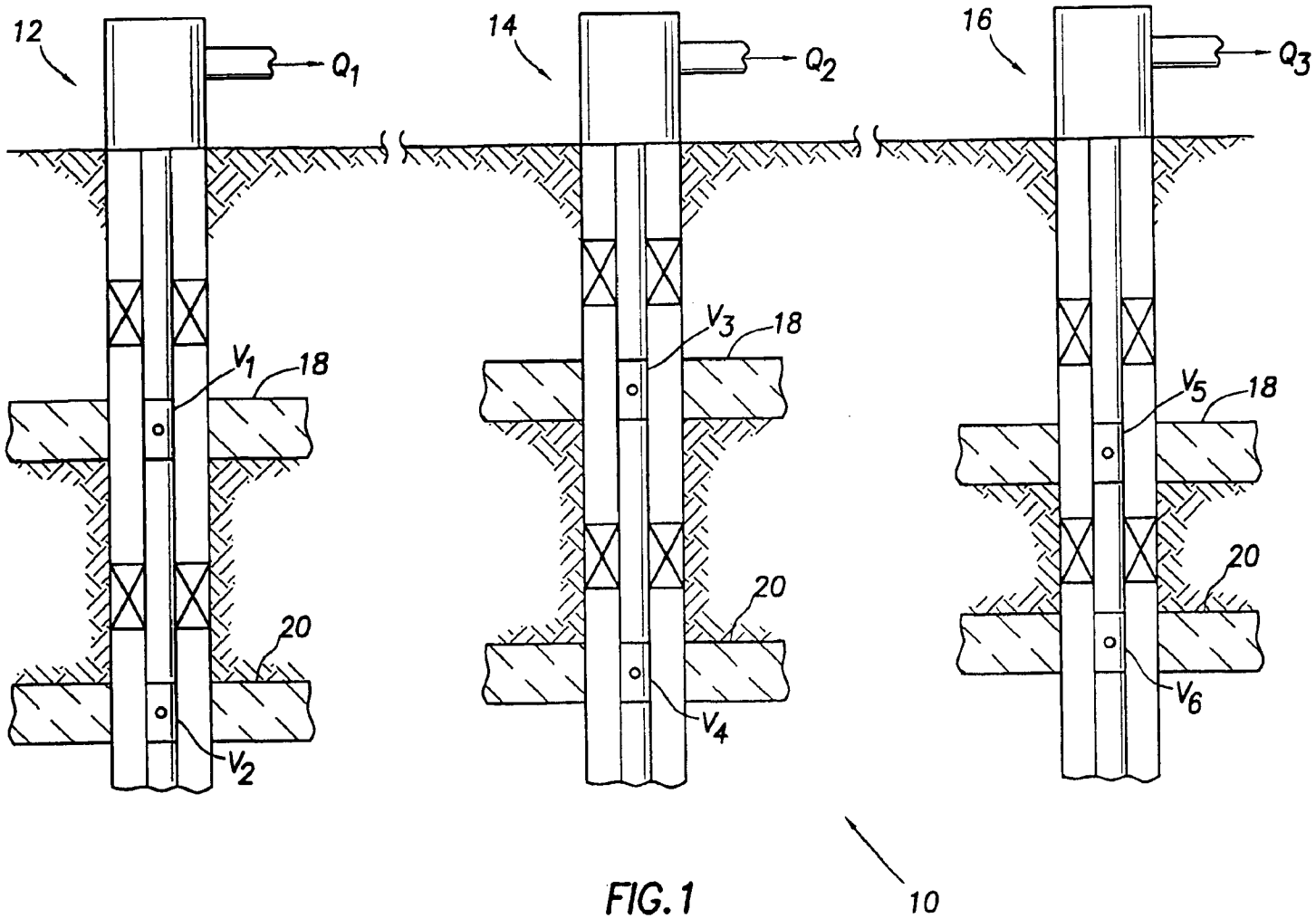
FIG. 1 is a schematic partially cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The method 10 is described herein as being used in conjunction with a well system including production wells 12, 14, 16 as depicted in FIG. 1. However, it is to be clearly understood that the method 10 is merely an example of a wide variety of methods which may incorporate principles of the present invention. Other examples include methods wherein the well system includes a greater or fewer number of wells, the well system includes one or more injection wells, the well system drains a greater or fewer number of reservoirs, the well system includes wells which produce from, or inject into, a greater or fewer number of zones, etc. Thus, the principles of the present invention may be used in methods wherein the well system is merely one well draining a single reservoir via one zone intersected by the well, and in methods wherein a large number of wells are used to drain multiple reservoirs and water flood or steam injection, etc., is used to enhance production.

As depicted in FIG. 1, each of the wells 12, 14, 16 intersects two reservoirs 18, 20. Two production valves or chokes are used in each well to regulate production from the individual reservoirs, that is, well 12 includes valves V1 and V2 to regulate production from reservoirs 18, 20, respectively, well 14 includes valves V3, V4 to regulate production from reservoirs 18, 20, respectively, and well 16 includes valves V5, V6 to regulate production from reservoirs 18, 20, respectively.

An output of well 12 is designated Q1, an output of well 14 is designated Q2, and an output of well 16 is designated Q3 in FIG. 1. These outputs Q1, Q2, Q3 include parameters such as production rate of oil, production rate of gas, production rate of water, oil quality, gas quality, etc. These parameters are indicative of the output of each well. Of course, other parameters, and greater or fewer numbers of parameters, may be used to indicate a well's output in methods embodying principles of the present invention. In addition, it should be understood that, as used herein, the term "well output" is used to indicate performance of a well and may be used to describe the performance of an injection well, as well as the performance of a production well. For example, the "output" of an injection well may be indicated by parameters such as injection rate, steam temperature, etc.

It will be readily appreciated that the outputs Q1, Q2, Q3 may be changed by varying the positions of the valves V1, V2, V3, V4, V5, V6. For example, by decreasing the flow area through the valve V1, production from the reservoir 18 in the well 12 may be decreased, and by increasing the flow area through the valve V2, production from the reservoir 20 in the well 12 may be increased.

However, since production from the reservoir 18 in any of the wells 12, 14, 16 influences production from the reservoir 18 in the other wells, production from the reservoir 20 influences production from the reservoir 20 in the other wells, and production from either of the reservoirs may influence production from the other reservoir, the outputs Q1, Q2, Q3 of the wells are interrelated in a very complex manner. In addition, production rates from each of the reservoirs 18, 20 should be maintained within prescribed limits to prevent damage to the reservoirs, while ensuring efficient and economical operation of the wells 12, 14, 16.

In the method 10, data is accumulated to facilitate training of a neural network 22 (see FIG. 3), so that the neural network may be used to predict the well outputs Q1, Q2, Q3 in response to parameters influencing those outputs. The data is representatively illustrated in FIG. 2 as multiple data sets 24. The data sets 24 include parameters 26 influencing the outputs of the individual wells 12, 14, 16 and parameters 28 indicative of the well outputs Q1, Q2, Q3. In the simplified example depicted in FIG. 2, the influencing parameters 26 are positions of the valves V1, V2, V3, V4, V5, V6 at n instances. Thus, data set 1 includes a position V1,1 of valve V1, position V2,1 of valve V2, position V3,1 of valve V3, etc. The indicative parameters 28 include production rates from the wells 12, 14, 16. Thus, data set 1 includes a production rate Q1,1 from well 12, a production rate Q2,1 from well 14 and a production rate Q3,1 from well 16.

Figure 2:
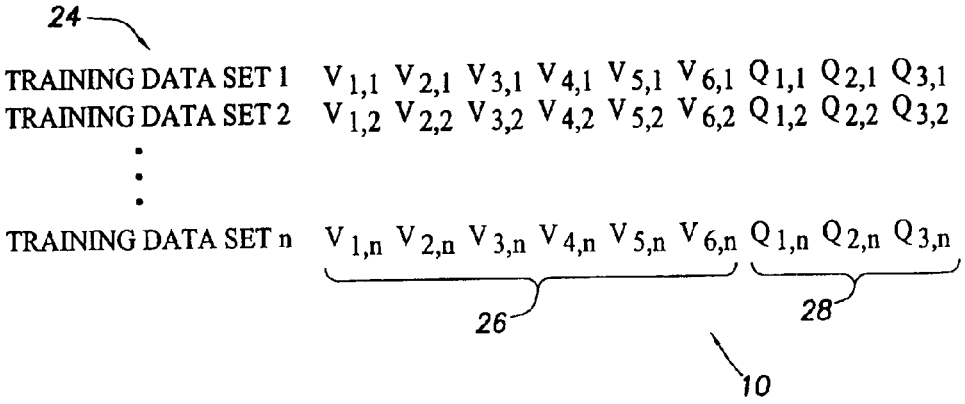
FIG. 2 depicts a data accumulation step of the method.

It is to be clearly understood that the influencing parameters 26 and indicative parameters 28 used in the simplified example of data sets 24 depicted in FIG. 2 are merely examples of a wide variety of parameters which may be used to train neural networks in methods embodying principles of the present invention. For example, another influencing parameter could be steam injection rate, and another indicative parameter could be oil gravity or water production rate, etc. Therefore, it may be seen that any parameters which influence or indicate well output may be used in the data sets 24, without departing from the principles of the present invention.

The data sets 24 are accumulated from actual instances recorded for the wells 12, 14, 16. The data sets 24 may be derived from historical data including the various instances, or the data sets may be accumulated by intentionally varying the influencing parameters 26 and recording the indicative parameters 28 which result from these variations.

Figure 3:
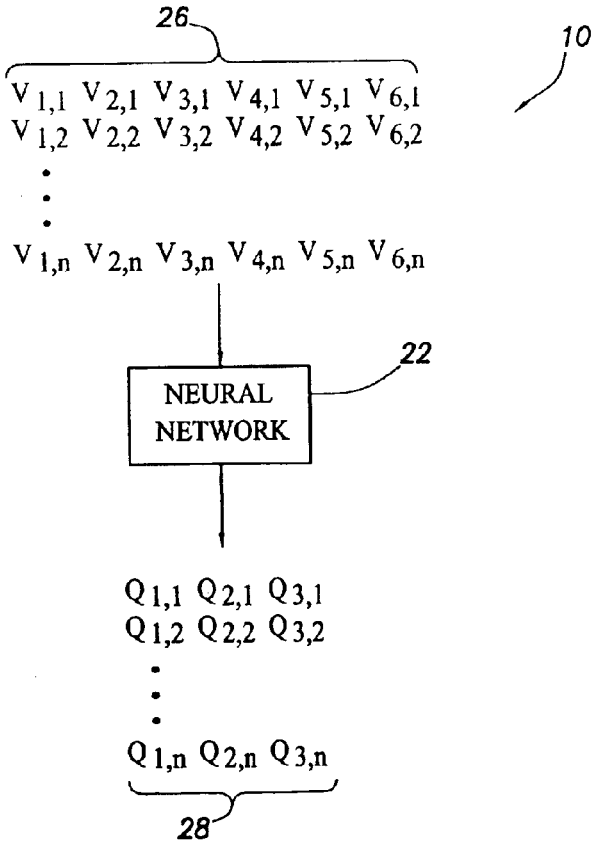
FIG. 3 depicts a neural network training step of the method.

Referring additionally now to FIG. 3, the neural network 22 is trained using the data sets 24. Specifically, the influencing parameters 26 are input to the neural network 22 to train the neural network to output the indicative parameters 28 in response thereto. Such training methods are well known to those skilled in the neural network art.

The neural network 22 may be any type of neural network, such as a perceptron network, Hopfield network, Kohonen network, etc. Furthermore, the training method used in the method 10 to train the network 22 may be any type of training method, such as a back propagation algorithm, the special algorithms used to train Hopfield and Kohonen networks, etc.

After the neural network 22 has been trained, it will output the indicative parameters 28 in response to input thereto of the influencing parameters 26. Thus, the neural network 22 becomes a model of the well system. At this point, prospective values for the influencing parameters may be input to the neural network 22 and, in response, the neural network will output resulting values for the indicative parameters. That is, the neural network 22 will predict how the well system will respond to chosen values for the influencing parameters. For example, in the method 10, the neural network 22 will predict the outputs Q1, Q2, Q3 for the wells 12, 14, 16 in response to inputting prospective positions of the valves V1, V2, V3, V4, V5, V6 to the neural network.

The output of the neural network 22 may be very useful in optimizing the economic value of the reservoirs 18, 20 drained by the well system. As discussed above, production rates can influence the ultimate quantity and quality of hydrocarbons produced from a reservoir, and this affects the value of the reservoir, typically expressed in terms of "net present value" (NPV).

Figure 4:
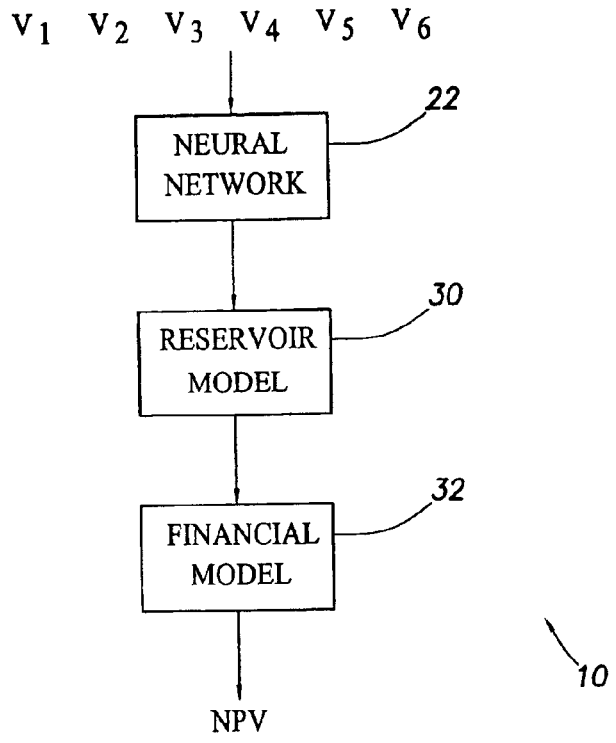
FIG. 4 depicts an optimizing step of the method.

Referring additionally now to FIG. 4, the method 10 is depicted wherein the neural network 22, trained as described above and illustrated in FIG. 2, is used to evaluate the NPV of the reservoirs 18, 20. The neural network 22 output is input to a conventional geologic model 30 of the reservoirs 18, 20 drained by the well system. The reservoir model 30 is capable of predicting changes in the reservoirs 18, 20 due to changes in the well system as output by the neural network 22. An example of such a reservoir model is described in U.S. patent application Ser. No. 09/357,426, entitled A SYSTEM AND METHOD FOR REAL TIME RESERVOIR MANAGEMENT, the entire disclosure of which is incorporated herein by this reference.

The output of the reservoir model 30 is then input to a conventional financial model 32. The financial model 32 is capable of predicting an NPV based on the reservoir characteristics output by the reservoir model 30.

As shown in FIG. 4, prospective positions for the valves V1, V2, V3, V4, V5, V6 are input to the trained neural network 22. The neural network 22 predicts outputs Q1, Q2, Q3 of the well system, which are input to the reservoir model 30. The reservoir model 30 predicts the effects of these well outputs Q1, Q2, Q3 on the reservoirs 18, 20. The financial model 32 receives the output of the reservoir model 30 and predicts an NPV. Thus, an operator of the well system can immediately predict how a prospective change in the positions of one or more production valves will affect the NPV.

In addition, using conventional numerical optimization techniques, the operator can use the combined neural network 22, reservoir model 30 and financial model 32 to obtain a maximum NPV. That is, the combined neural network 22, reservoir model 30 and financial model 32 may be used to determine the positions of the valves V1, V2, V3, V4, V5, V6 which maximize the NPV.

Figure 5:
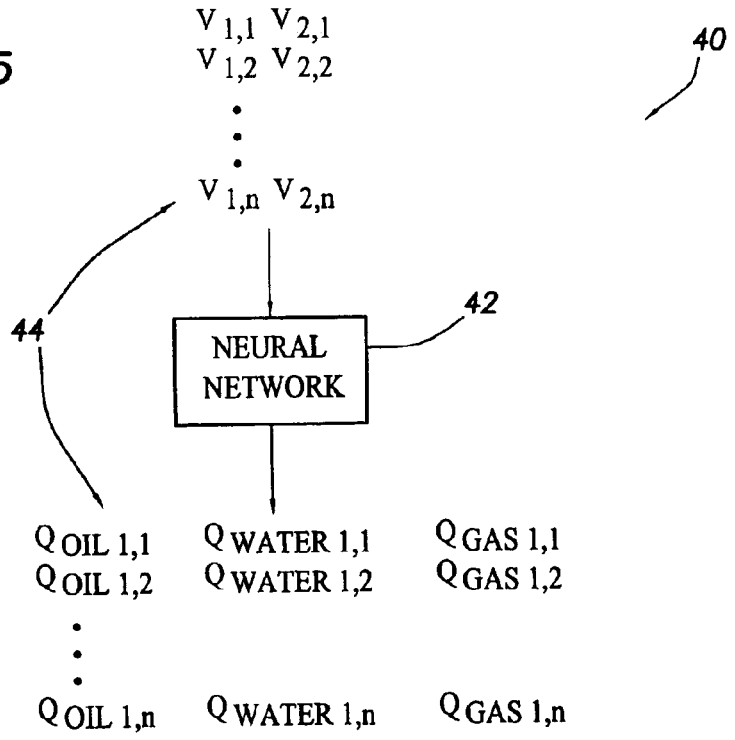
FIG. 5 depicts another method embodying principles of the present invention.

Referring additionally now to FIG. 5, another method 40 embodying principles of the present invention is representatively illustrated. Rather than modeling the performance of a field including multiple wells, as in the method 10, the method 40 utilizes a neural network 42 to model the performance of a single well, such as the well 12 described above and depicted in FIG. 1.

In the method 40, the data sets 44 used to train the neural network include instances of positions of the valves V1 and V2, and resulting instances of production rates of oil (Qoil), production rates of water (Qwater) and production rates of gas (Qgas) from the well 12. As shown in FIG. 5, the valve positions are input to the neural network 42, and the neural network is trained to output the resulting production rates Qoil, Qwater, Qgas in response. Thus, the neural network 42 in the method 40 models the performance of the well 12 (a well system having a single well).

Similar to the method 10, the neural network 42 in the method 40 may be used to predict the performance of the well 12 in response to input to the neural network of prospective positions of the valves V1, V2 after the neural network is trained. An operator of the well 12 can, thus, predict how the performance of the well 12 will be affected by changes in the positions of the valves V1, V2. Use of a reservoir model and a financial model, as described above for the method 10, will also permit an operator to predict how the NPV will be affected by the changes in the positions of the valves V1, V2. Furthermore, numerical optimization techniques may be utilized to determine positions of the valves V1, V2 which maximize the NPV.

The method 40, thus, demonstrates that the principles of the present invention may be utilized for well systems of various configurations. Note, also, that neural networks may be trained in various manners, for example, to predict various parameters indicative of well system performance, in keeping with the principles of the present invention.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of optimizing performance of a well system, the method comprising the steps of:

accumulating multiple data sets, each data set including at least one parameter influencing an output of the well system, and at least one parameter indicative of the well system output;

training a neural network to model the output of the well system in response to the influencing parameters; and inputting an output of the trained neural network to a geologic model.

2. The method according to claim 1, wherein the training step further comprises training the neural network utilizing the data sets, the trained neural network outputting the indicative parameters in response to input of the respective influencing parameters to the neural network.

3. The method according to claim 1, wherein in the accumulating step, the influencing parameters include valve positions.

4. The method according to claim 1, wherein in the accumulating step, the indicative parameters include production rates.

5. The method according to claim 1, further comprising the step of inputting an output of the geologic model to a financial model.

6. The method according to claim 5, further comprising the step of optimizing an output of the financial model in response to input of prospective influencing parameters to the neural network.

7. The method according to claims 6, wherein the optimizing step further comprises determining a respective value for each of the prospective influencing parameters, whereby the output of the financial model in response to input of the prospective influencing parameters to the neural network is optimized.

8. A method of optimizing performance of a well system, the method comprising the steps of:

training a neural network to model an output of the well system in response to at least one variable parameter of the well system;

inputting an output of the neural network to at least one valuing model; and optimizing an output of the valuing model in response to input of the well system parameter to the neural network.

9. The method according to claims 8, wherein the training step further comprises inputting multiple data sets to the neural network, each of the data sets including at least one known parameter influencing the well system output.

10. The method according to claim 9, wherein in the training step, the known influencing parameter is a position of a valve in the well system.

11. The method according to claim 9, wherein the training step further comprises training the neural network to output at least one known parameter indicative of the well system output in response to the input to the neural network of the known influencing parameter.

12. The method according to claim 11, wherein in the training step, the known indicative parameter is a production rate in the well system.

13. The method according to claim 8, wherein in the inputting step, the at least one valuing model includes a geologic model and a financial model.

14. The method according to claim 13, wherein in the inputting step, the output of the neural network is input to the geologic model, and an output of the geologic model is input to the financial model.

15. The method according to claim 8, wherein in the optimizing step, the well system parameter is varied to maximize the valuing model output.

* * * * *